US007988837B2

(12) United States Patent
Aylwin G. et al.

(10) Patent No.: US 7,988,837 B2
(45) Date of Patent: Aug. 2, 2011

(54) SET OF PARTS FOR POSITIONING ELECTRODES IN CELLS FOR THE ELECTRODEPOSITING OF METALS

(75) Inventors: Pedro Aylwin G., Santiago (CL); Hernan Escobar C., Santiago (CL)

(73) Assignee: New Tech Copper S.A., Santiago (CL)

( * ) Notice: Subject to any disclaimer, the term of this patent is extended or adjusted under 35 U.S.C. 154(b) by 350 days.

(21) Appl. No.: 12/256,557

(22) Filed: Oct. 23, 2008

(65) Prior Publication Data

US 2009/0173624 A1 Jul. 9, 2009

(30) Foreign Application Priority Data

Jan. 7, 2008 (CL) ..... 0032-2008

(51) Int. Cl.
*C25B 9/02* (2006.01)

(52) U.S. Cl. ..... 204/286.1; 20/279; 20/281; 20/297.01; 20/297.06

(58) Field of Classification Search ..... 204/281, 204/279, 286.1, 297.01, 297.06
See application file for complete search history.

(56) References Cited

U.S. PATENT DOCUMENTS

| | | | | |
|---|---|---|---|---|
| 6,231,730 | B1 * | 5/2001 | Davis et al. | 204/279 |
| 6,391,170 | B1 * | 5/2002 | Day et al. | 204/279 |
| 7,217,345 | B2 * | 5/2007 | Casanova | 204/224 R |
| 7,479,209 | B2 * | 1/2009 | Casanova | 204/279 |
| 2007/0284243 | A1 * | 12/2007 | Aylwin et al. | 204/198 |

* cited by examiner

*Primary Examiner* — Bruce F Bell
(74) *Attorney, Agent, or Firm* — Sughrue Mion, PLLC

(57) ABSTRACT

A vertical guide for electrodes characterized in that it includes 1) an upper portion or aligning head and a lower portion that corresponds to the guide itself, whose aligning head, designed to make it easier to introduce the cathode in the guide, has cylindrical-hexahedral perforations that permit attaching the vertical guide by means of bolts or another means to the electrolytic cell's support structure made of insulating material; 2) the head formed by a cylindrical housing having a horizontal axis and two inclined symmetrical surfaces that approach each other in a downward line until they become tangential to the interior faces of the "U" profile that continues downward, so that they are similar to a funnel open on one side; 3) a lower portion made up of the actual guide, whose space through which the electrode slides must be slightly wider than it, consists of a U-type profile with flanges, and which, on the outside, has triangular, or rectangular stiffening ribs, or both types, preferably separated at regular intervals; and 4) a lower end that is introduced into the vertical housing of the union elbow.

14 Claims, 27 Drawing Sheets

SET OF PARTS FOR POSITIONING ELECTRODES IN CELLS FOR THE ELECTRODEPOSITING OF METALS

FIELD OF THE INVENTION

The present invention relates to an apparatus or set of parts for positioning electrodes in cells for the electrodepositing or electroplating of metals.

CROSS-REFERENCE TO RELATED APPLICATION

This application claims priority to Chilean Patent Application No. 32-2008 filed Jan. 7, 2008, the entire disclosure of which is incorporated herein by reference.

BACKGROUND OF THE INVENTION

In the industrial processes for electroplating, it is customary to hang cathodes and anodes and submerge them in the electrolyte of the electrolysis cells or tanks, placing the support bar of each anode or cathode directly over the bus bars that are located in the upper longitudinal borders of the cells. With this system, whereby the anodes and cathodes have guides for their movement inside the tanks, they cannot oscillate as if they were pendulums submerged in the electrolyte.

Consequently, a large part of the inconveniences were corrected by introducing a support structure made of insulating material inside the cell, such as the one described in Chilean Patent Application N° 1020-04, in which each anode and each cathode is located in a fixed vertical position by means of guides that also ensure a uniform spacing between them, thus also preventing the relative movement of these. Although the structure resolves the problems inherent to the lack of electrode guides (oscillation), it so happens that careless use or operation can provoke an alteration, slight damages or breakage in the anode or cathode guides; and in order to repair them the process must be stopped, the support structure of insulating material removed completely from the cell, and the repairs carried out.

Another inconvenience of the current operation of electroplating cells arises during the introduction of the cathodes between the anodes once these have been submerged in the cell. The cathodes, which currently consist of sheets of stainless steel, must be inserted in lateral vertical guides such as those indicated in Chilean Patent Application N° 1020-04. This operation is executed by hanging the cathodes by the upper bars on a support which is transferred to a Cell using a crane, making them descend so that they will be introduced between the anodes. As the separation distance between anodes in the Cell is approximately 10 centimeters, during the introduction there are frequent impacts of the lower borders of the cathodes with the upper bars of the anodes, which produces deformation or breakage of the sheets or bars and delays the operation unnecessarily.

SUMMARY OF THE INVENTION

Lately the production of metals by using electrolysis has been using support structures of insulating material with vertical guides in order to maintain the anodes and cathodes in position inside the Cells during the production process.

Although this system resolves a series of problems, when for some reason the guides need to be repaired, it requires waiting until the end of the process, removing all the Anodes and Cathodes, emptying the electrolyte and removing the structure that supports the cell in order to execute the repairs. This procedure implies delays and losses in production.

The present invention proposes a set of independent parts or pieces that have a particular morphology, they can be assembled and dismounted, which permits each of them to operate or function independently, within an inventive unit for the purpose of positioning the electrodes in cells for the electrodepositing of metals.

With the functionality of the invention proposed here, the interruption of the electrowinning process as a consequence of any breaking or damaging that may occur to an electrode guide can be avoided. In this way the invention contributes to the technique from the moment that it permits giving continuity to the operation, accelerating it, and at the same time, maintains the contribution of improving the service life of anodes and cathodes, from the moment that it no longer becomes necessary to empty the electrolyte from the cells, extract the guide structure to repair, correct or replace a guide, with the resulting risk of deterioration for the electrodes.

BRIEF DESCRIPTION OF THE DRAWINGS

FIG. 1-1 shows an Isometric view of a Vertical Cathode Guide with rectangular stiffening ribs.

FIG. 1-2 shows an Isometric view of a Vertical Cathode Guide with triangular and rectangular stiffening ribs.

FIG. 2 shows a frontal Elevation view of the Vertical Cathode Guide with triangular stiffening ribs.

FIG. 2-1 shows a frontal Elevation view of the Vertical Cathode Guide with rectangular stiffening ribs.

FIG. 3-1 shows a rear Elevation view of the Vertical Cathode Guide with rectangular stiffening ribs.

FIG. 4-1 shows a Lateral view of the Vertical Cathode Guide with rectangular stiffening ribs.

FIG. 5-1 shows a Plan view of the Vertical Cathode Guide with rectangular stiffening ribs.

FIG. 10-1 shows an Isometric view of the Lower Horizontal Guide Profile.

FIG. 11-1 shows an Isometric view of the lower part of the Vertical Cathode Guide with rectangular stiffening ribs.

FIG. 11-2 shows a cross-section view of the lower part of the Vertical Cathode Guide with rectangular stiffening ribs.

FIG. 11-3 shows a cross-section view of the lower part of the Vertical Cathode Guide with triangular and rectangular stiffening ribs.

FIG. 12-1 shows a Frontal Elevation view of the long version of the Union Elbow of the Vertical Cathode Guide with the cathode's Lower Horizontal Guide Profile, when the same Profile of the inferior zone of the vertical cathode guide is used as a bottom guide for the cathode.

FIG. 12-2 shows a Frontal Elevation view of the short version of the Union Elbow of the Vertical Cathode Guide with the cathode's Lower Horizontal Guide Profile when the cathode's bottom guide is not used.

FIG. 13-1 shows a Profile view of the long version of the Union Elbow of the Vertical Cathode Guide with the cathode's Lower Horizontal Guide Profile, when the same Profile of the bottom zone of the vertical cathode guide is used as lower guide of the cathode.

FIG. 13-2 shows a Profile view of the short version of the Elbow Union of the Vertical Cathode Guide with the cathode's Lower Horizontal Guide Profile when a lower guide for the cathode is not used.

FIG. 14-1 shows a Plan view of the long version of the Elbow Union of the Vertical Cathode Guide with the cathode's Lower Horizontal Guide Profile when the same Profile of the inferior zone of the vertical cathode guide is used as lower guide of the cathode.

FIG. 14-2 shows a Plan view of the short version of the Elbow Union of the Vertical Cathode Guide with the cathode's Lower Horizontal Guide Profile, when a bottom cathode guide is not used.

FIGS. 15, 15-1, 15-2 show inferior longitudinal spacers of anodes or cathodes.

FIG. 16-1 shows a frontal Elevation view of the part with two-diameter cylindrical perforation of the Inferior Longitudinal Anode Spacer, in its version with springs.

FIG. 16-2 shows a frontal Elevation view of the part with cylindrical-hexahedral perforation of the Inferior Longitudinal Anode Spacer, in its version without springs.

FIG. 16-3 shows a frontal Elevation view of the part with two-diameter cylindrical perforation of the Inferior Longitudinal Anode Space, in its version without springs.

FIG. 17-1 shows a Profile view of the part with two-diameter cylindrical perforation of the Inferior Longitudinal Anode Spacer, in its version with springs.

FIG. 17-2 shows a Profile view of the part with cylindrical-hexahedral emptying of the Inferior Longitudinal Anode Spacer in its version without springs.

FIG. 17-3 shows a Profile view of the part with two-diameter cylindrical perforation of the Inferior Longitudinal Anode Spacer, in its version without springs.

FIG. 18-1 shows a Plan view of the part with two-diameter cylindrical perforation of the Inferior Longitudinal Anode Spacer, in its version with springs.

FIG. 18-2 shows a Plan view of the part with cylindrical-hexahedral emptying of the Inferior Longitudinal Anode Spacer in its version without springs.

FIG. 18-3 shows a Plan view of the part with two-diameter cylindrical emptying of the Inferior Longitudinal Anode Spacer in its version without springs.

FIG. 19-1 shows an Elevation view of the external electrode aligner in its reinforced version.

FIG. 19-2 shows an Upper Plan view of the external electrode aligner in its reinforced version.

FIG. 19-3 shows a Profile view of the external electrode aligner in its reinforced version.

FIG. 19-4 shows a Lower Plan view of the external electrode aligner in its reinforced version.

FIG. 20-1 shows an Elevation view of the external electrode aligner in its ovoid version.

FIG. 20-2 shows a Profile view of the external electrode aligner in its ovoid version.

FIG. 20-3 shows a Superior Plan view of the external electrode aligner in its ovoid version.

FIG. 21-1 shows an Elevation view of the external electrode aligner in its cylindrical version.

FIG. 21-2 shows a Profile view of the external electrode aligner in its cylindrical version.

FIG. 21-3 shows a Superior Plan view of the external electrode aligner in its cylindrical version.

Figure 1:
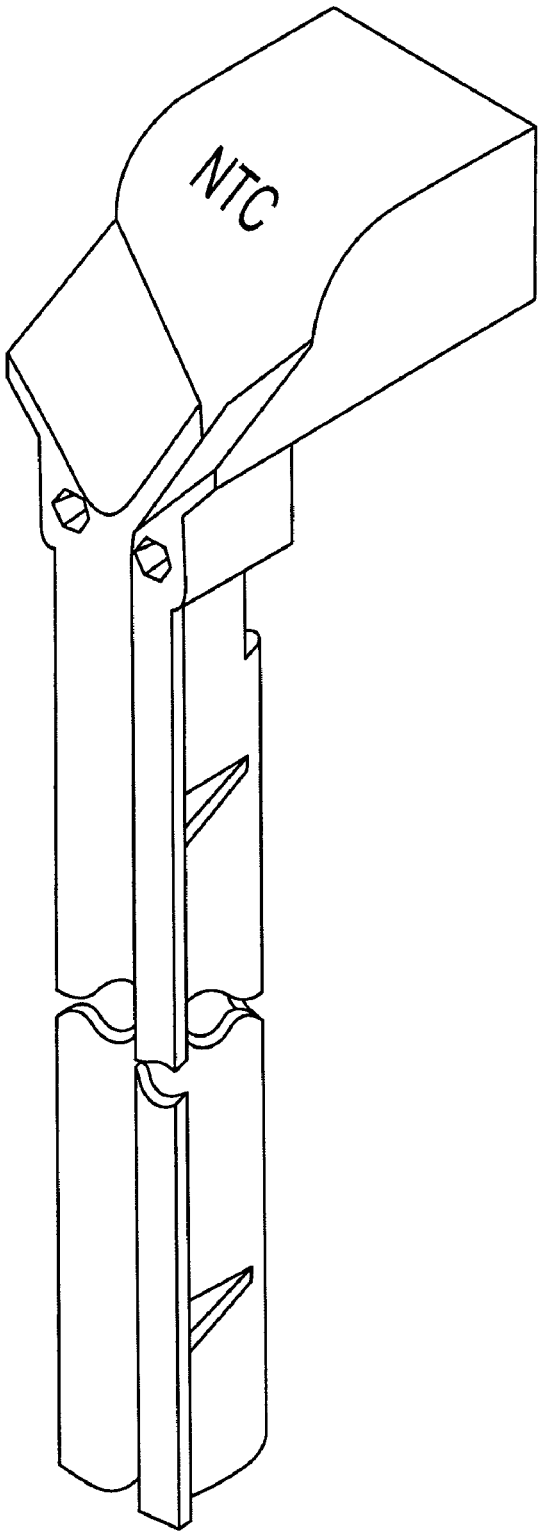
FIG. 1 shows an Isometric view of a Vertical Cathode Guide with triangular stiffening ribs.
Figure 1:
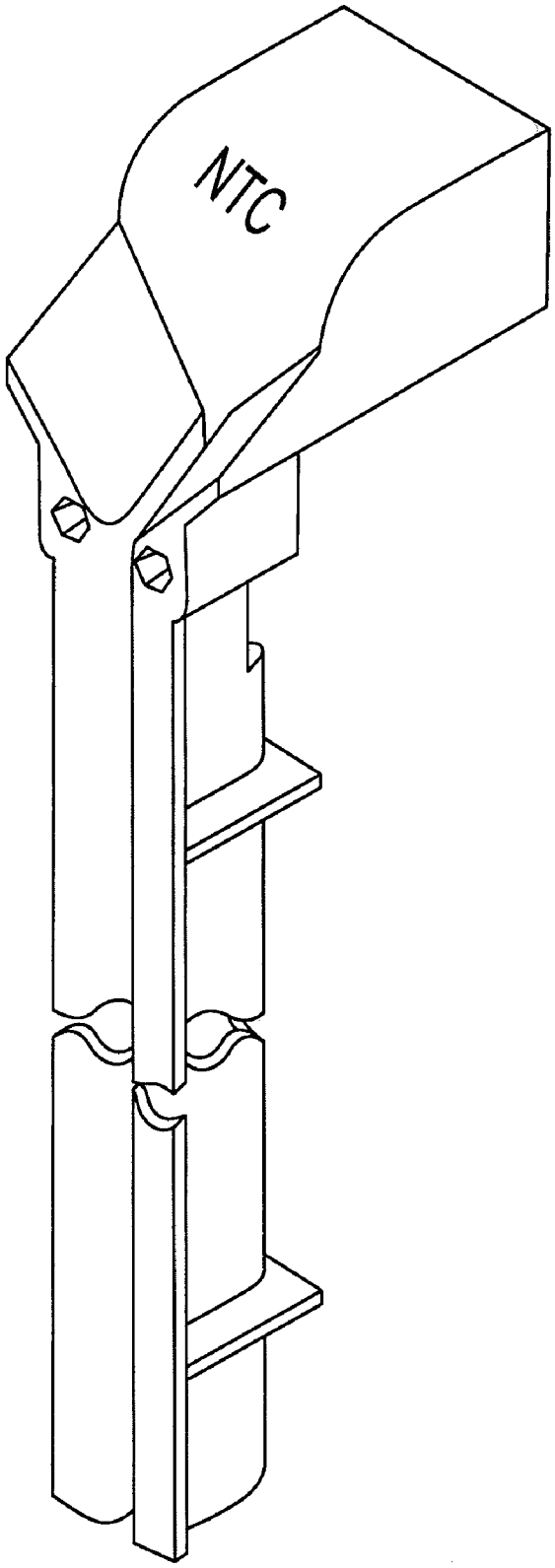

The numbers that indicate the details of the different Figures have the following meaning:

1. Upper portion of the Vertical Cathode Guide, which serves to align the lower part of the cathode, during its introduction in the guide of the lower portion of the Vertical Cathode Guide.

2. Perforation for placing the joint bolts of the Vertical Cathode Guide in the Electrolytic Cell's supporting structure made of insulating material.

3. Housing duct of the cathode's vertical border.

4. Triangular transversal stiffener of the Vertical Cathode Guide.

4-1. Rectangular transversal stiffener of the Vertical Cathode Guide.

5. Upper portion of the Union Elbow of the Vertical Cathode Guide with the Inferior Horizontal Guide Profile.

6. Perforation for placing bolts to fasten the Union Elbow of the Vertical Cathode Guide with the Inferior Horizontal Guide Profile to the Electrolytic Cell's support structure made of insulating material.

7. Housing duct of the lower end of the Vertical Cathode Guide.

8. Housing duct of the lower end of the flanges of the Vertical Cathode Guide.

9. Housing duct of one end of the Inferior Horizontal Guide Profile.

10. Housing duct of the inferior border of the Cathode.

11. Upper flange of the profile Cathode's Inferior Horizontal Guide.

12. Inferior flange of the Cathode's Inferior Horizontal Guide Profile.

13. Cylindrical perforation, to join, by means of a bolt or other joining system, the two halves of the Union Elbow of the Vertical Cathode Guide with the Inferior Horizontal Guide Profile.

14. Emptying to align the two halves of the Union Elbow and the Vertical Cathode Guide with the Inferior Horizontal Guide Profile, and make it easier to assemble.

15. Groove for housing the flange of the Inferior Horizontal Guide Profile when a Profile is used that is the same as the lower portion of the Vertical Cathode Guide.

16. Spring to hold the inferior horizontal border of the Cathode in position.

17. Hexahedral cylindrical perforation of the Inferior Anode Spacer for the assembly of its two halves, and at the same time for fixing it to the Electrolytic Cell's Support Structure of Insulating Material.

18. Two-diameter cylindrical perforation of the Inferior Anode Spacer for the assembly of its two halves and at the same time for fixing it to the Electrolytic Cell's Support Structure of Insulating Material.

19. Upper border of the external electrode aligner that serves as impact attenuator during the introduction of the cathodes in the Electrolysis Cell.

20. Small claws of the external electrode aligner, to attach by pressure to the anode or the anode's support bar.

DETAILED DESCRIPTION OF THE INVENTION

The present invention is made up of a set of pieces that are assembled, that have specific reinforcements that fill the function of geometric stabilizers to avoid a loss in or of its original form, and that resolve the problems of interruption of the electroplating work when the electrolyte in the cell has to be emptied to extract and replace the cathode guides in the support structure.

Figures 1, 2:
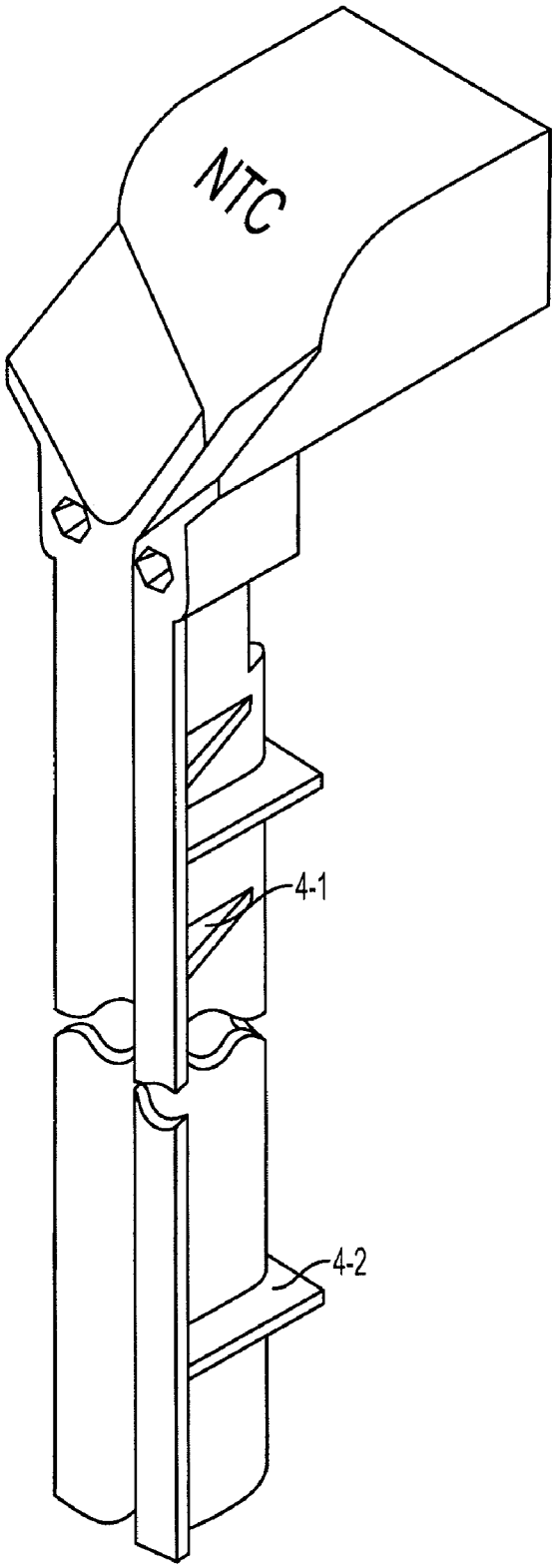
Figure 2:
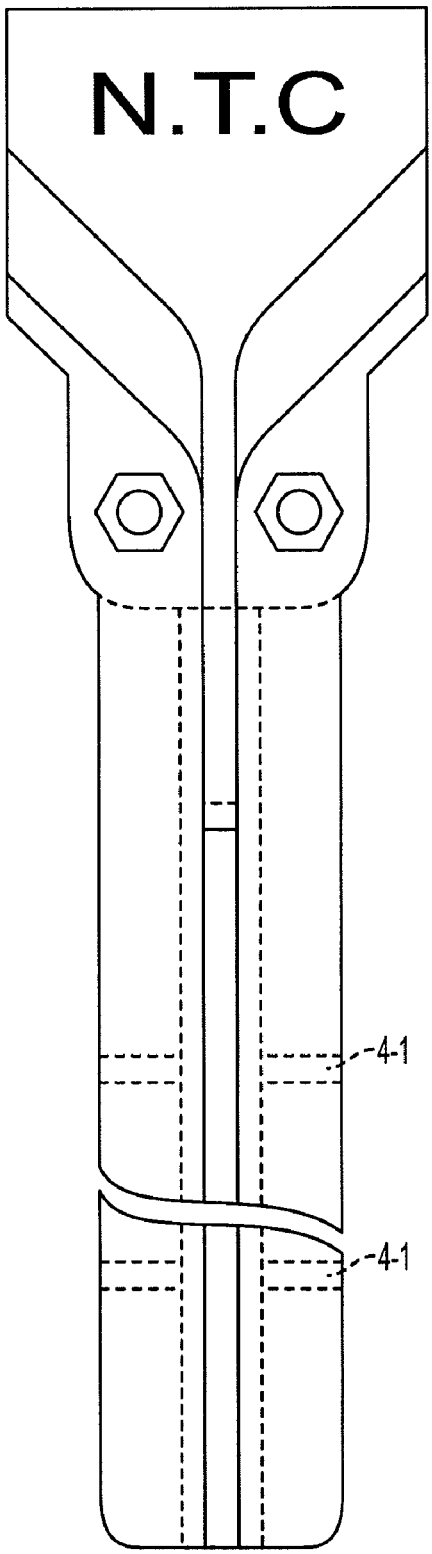
Figure 3:
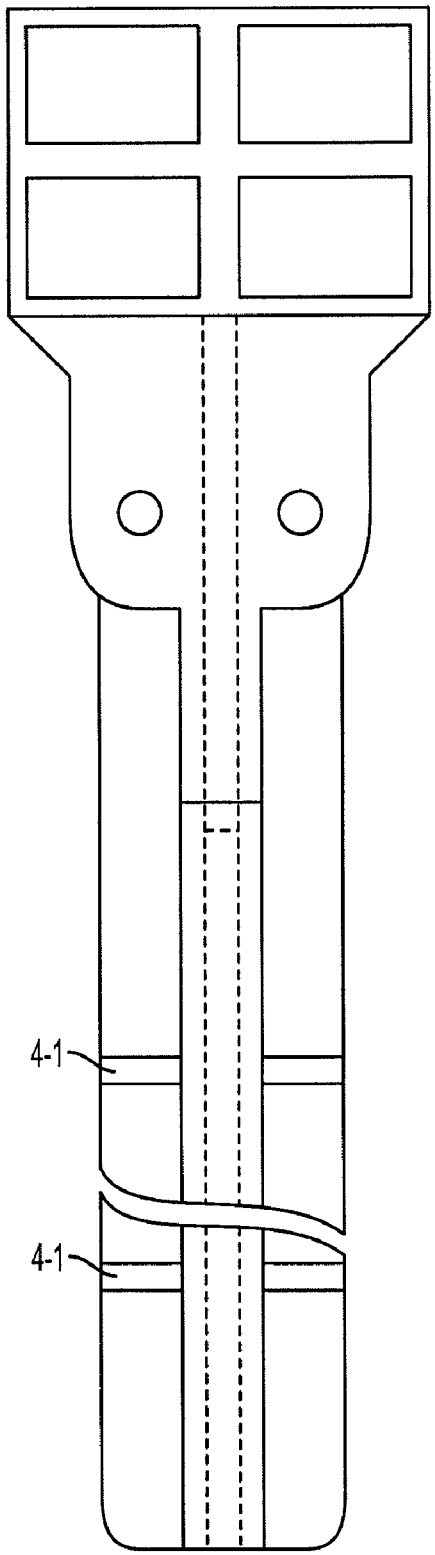
FIG. 3 shows a rear Elevation view of the Vertical Cathode Guide with triangular stiffening ribs.
Figures 1, 2:
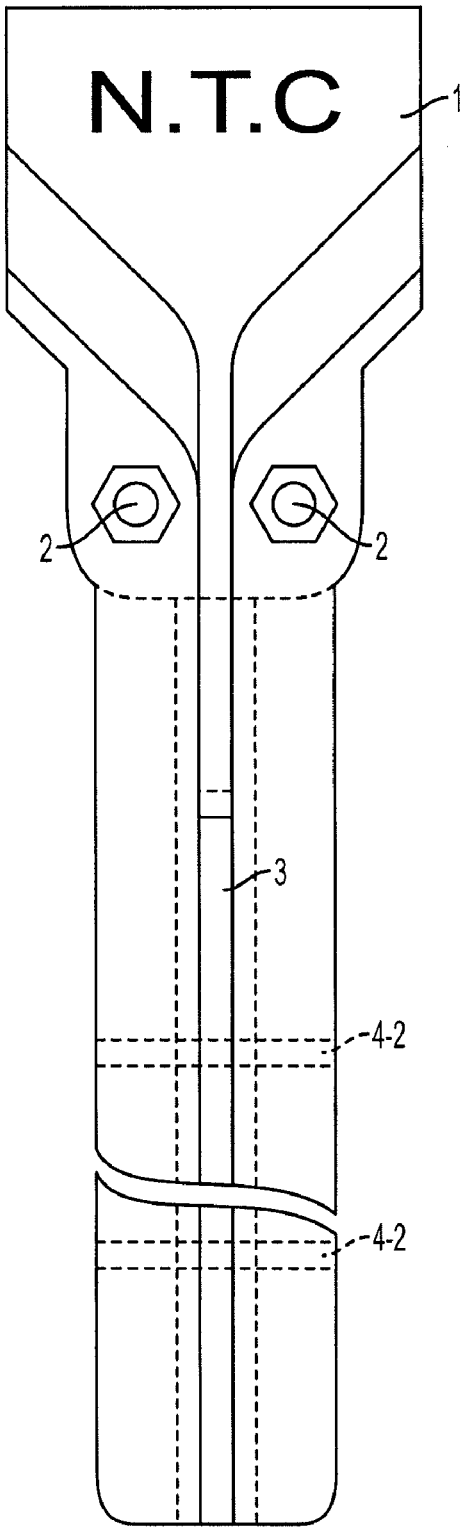
Figures 1, 3:
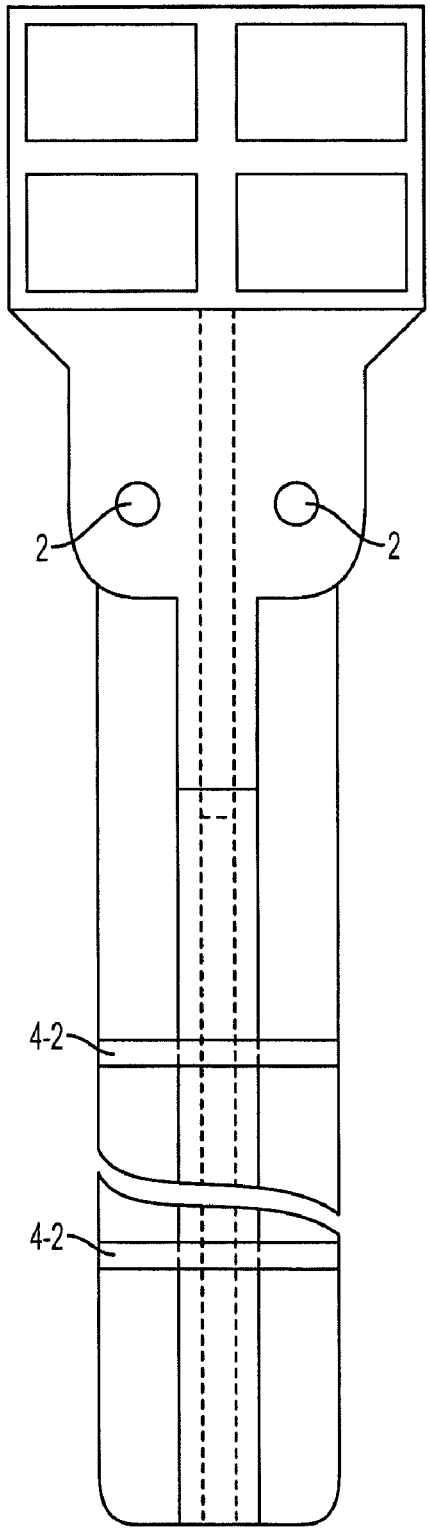
Figure 4:
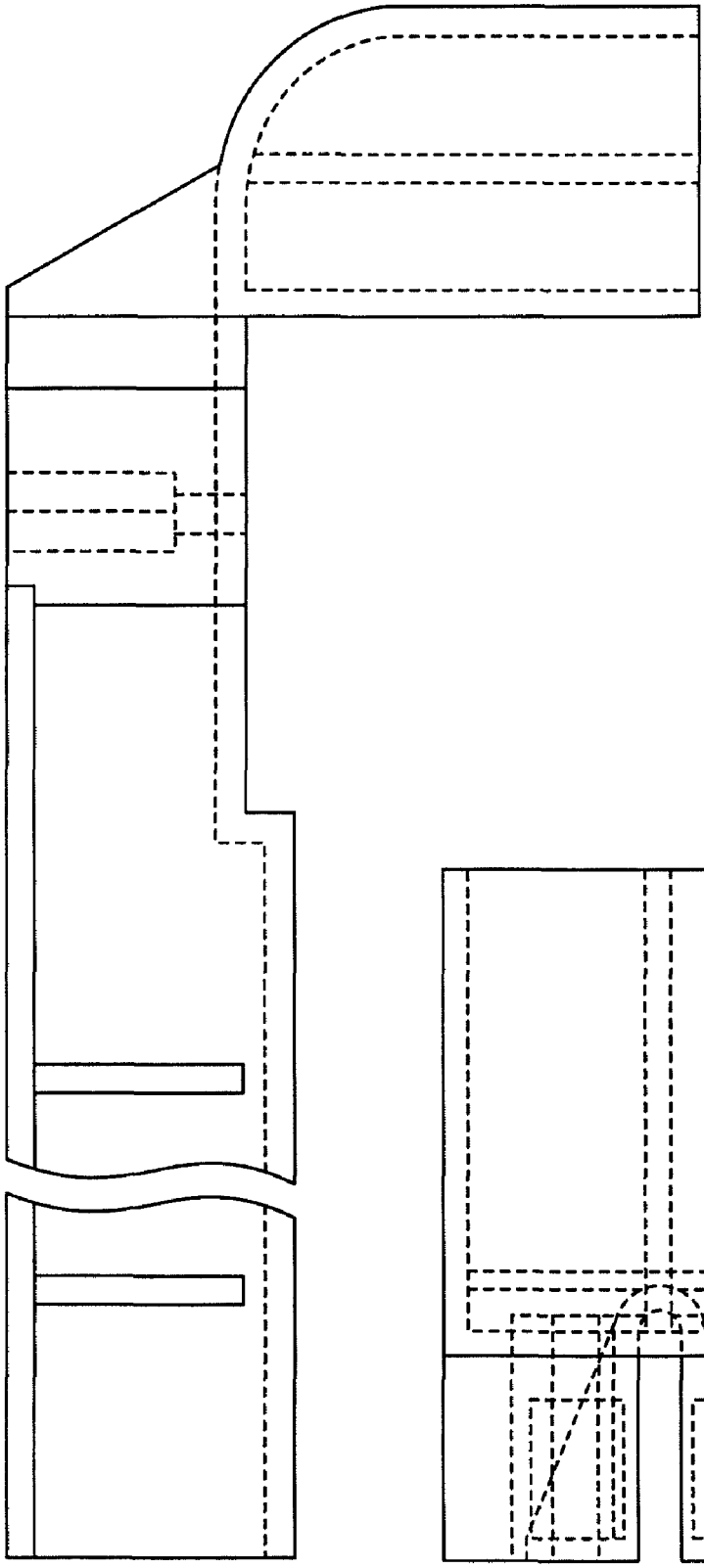
FIG. 4 shows a Lateral view of the Vertical Cathode Guide with triangular stiffening ribs.
Figure 5:
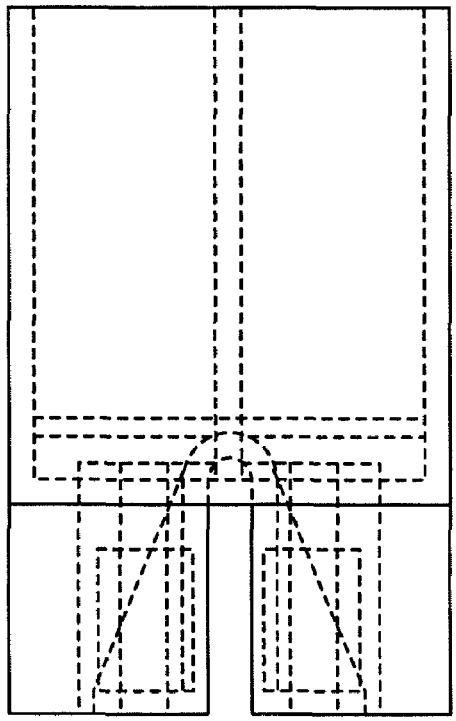
FIG. 5 shows a Plan view of the Vertical Cathode Guide with triangular stiffening ribs.
Figures 1, 4:
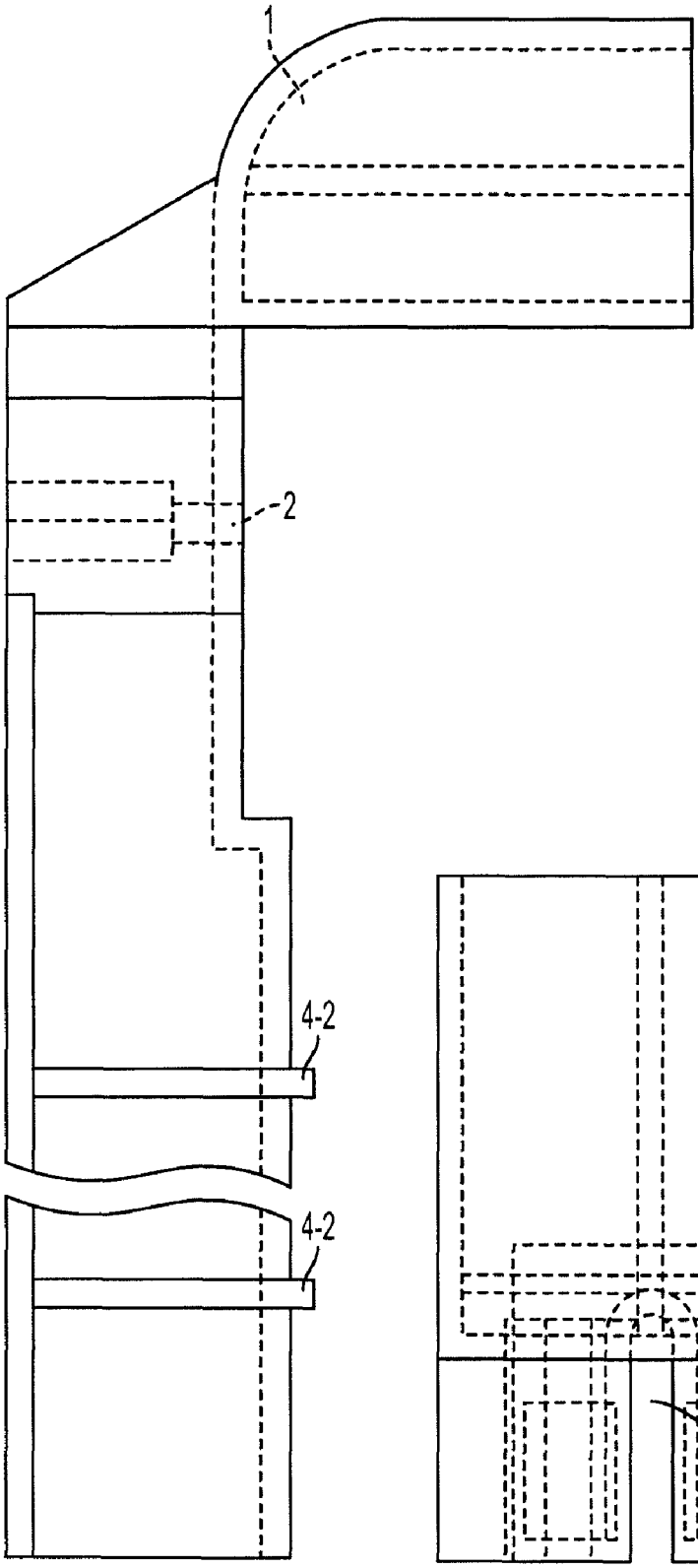
Figures 1, 5:
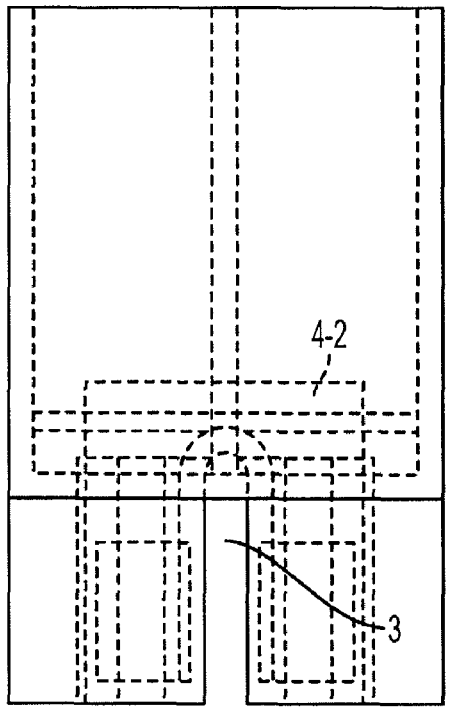
Figure 6:
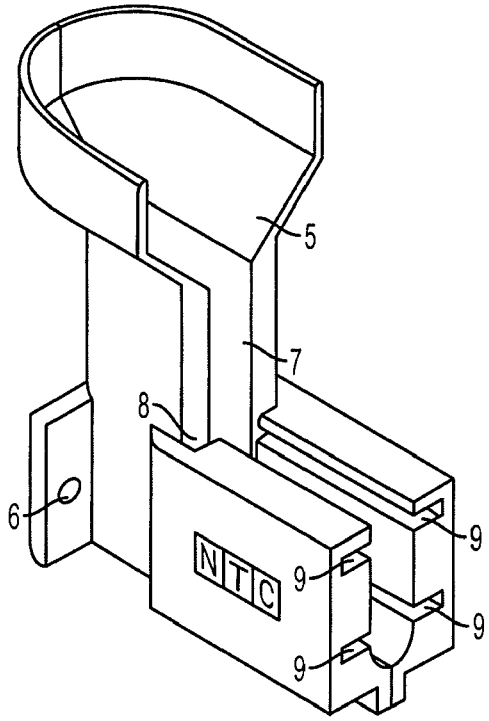
FIG. 6 shows an Isometric view of the Union Elbow of the Vertical Cathode Guide with the Lower Horizontal Guide Profile.
Figure 7:
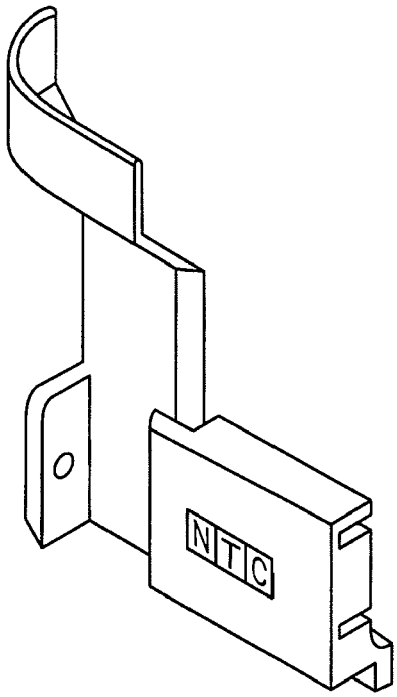
FIG. 7 shows an Isometric view of the left half of the Union Elbow of the Vertical Cathode Guide with the Lower Horizontal Guide Profile.
Figure 8:
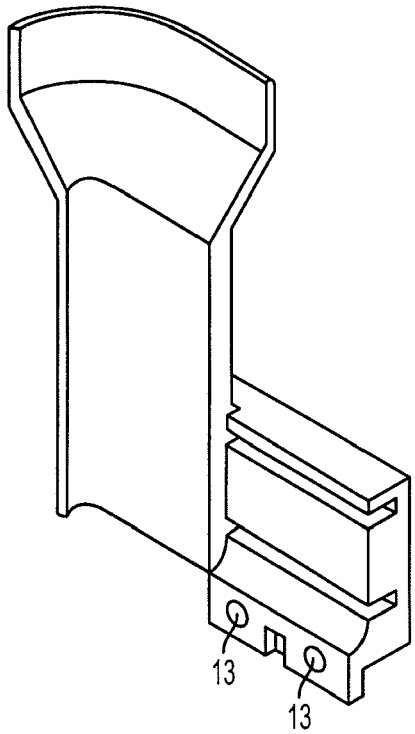
FIG. 8 shows an Isometric view of the right half of the Union Elbow of the Vertical Cathode Guide with the Lower Horizontal Guide Profile.
Figure 9:
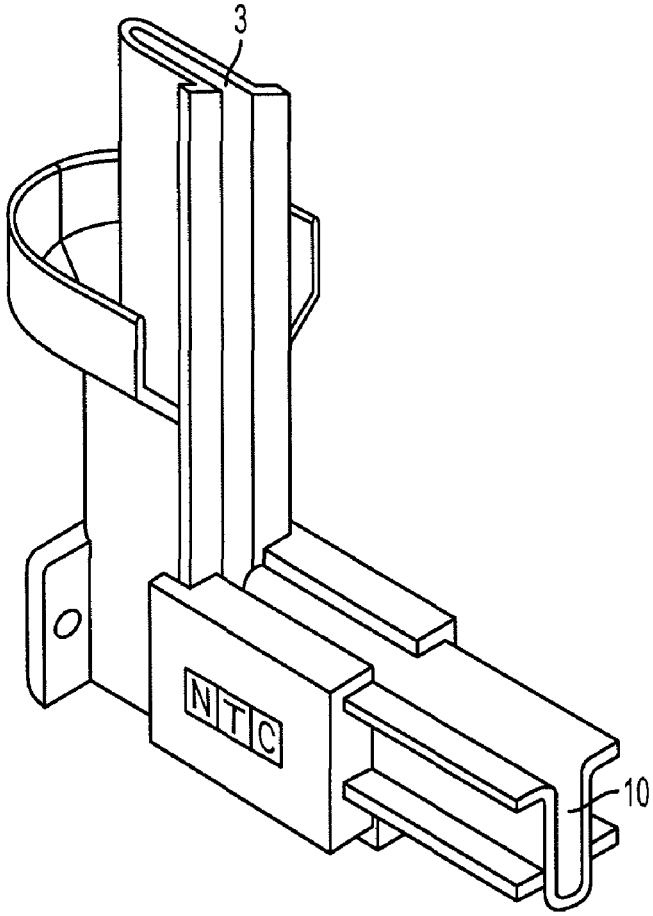
FIG. 9 shows an Isometric view of the Union Elbow of the Vertical Cathode Guide with the Lower Horizontal Guide Profile, with pieces of both guides inserted in the Union Elbow.

This set of pieces consists of:

Vertical Cathode Guides with upper aligner incorporated, like those in FIGS. 1, 1-1 and 1-2.

Union Elbows of the Vertical Cathode Guides with Inferior Horizontal Guide Profiles, like those in FIGS. 6, 12-1, 12-2, 13-1, 13-2, 14-1 and 14-2.

Figure 10:
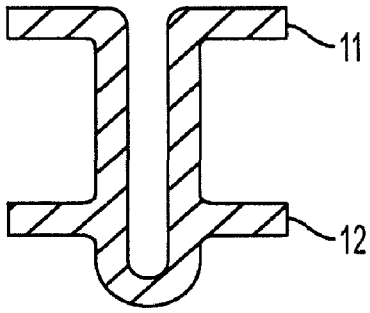
FIG. 10 shows a cross-section view of the Lower Horizontal Guide Profile.
Figure 11:
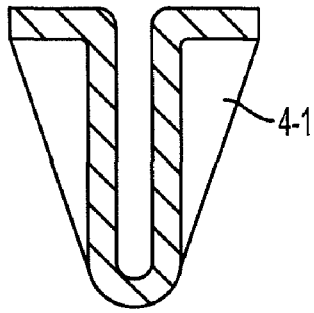
FIG. 11 shows a cross-section view of the lower part of the Vertical Cathode Guide with triangular stiffening ribs.
Figures 1, 10:
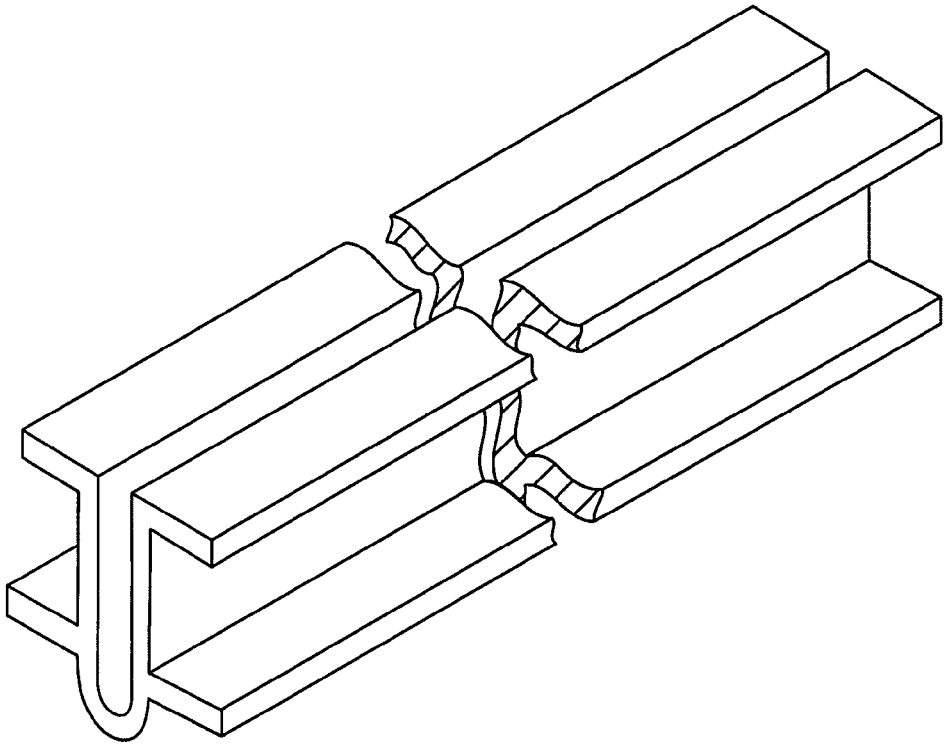
Figures 1, 11:
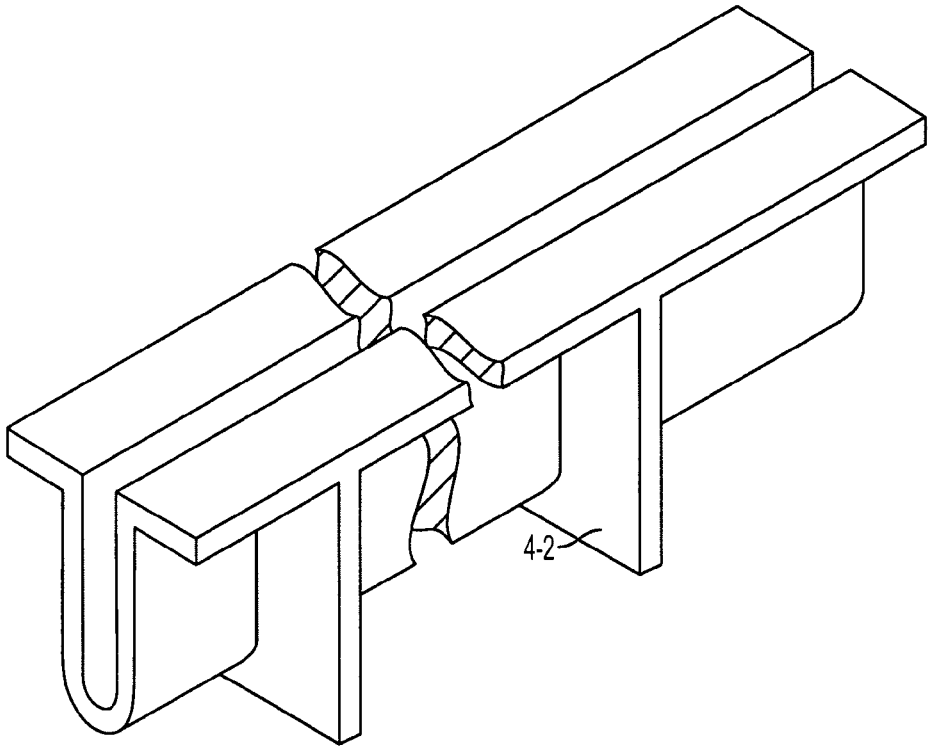
Figures 2, 11:
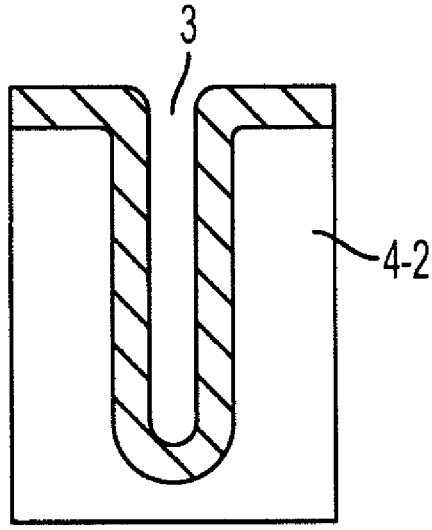
Figures 3, 11:
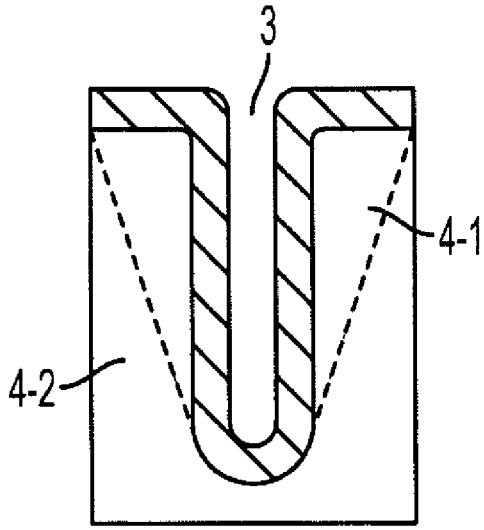
Figure 12:
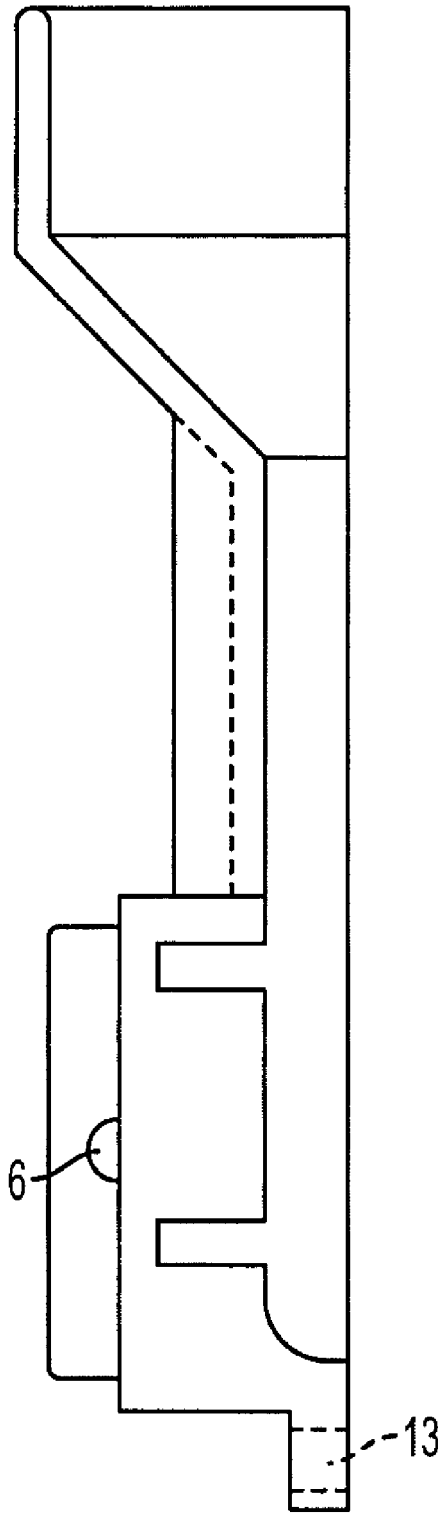
FIG. 12 shows an Elevation view of the left half of the Union Elbow of the Vertical Cathode Guide with the Lower Horizontal Guide Profile.
Figures 1, 12:
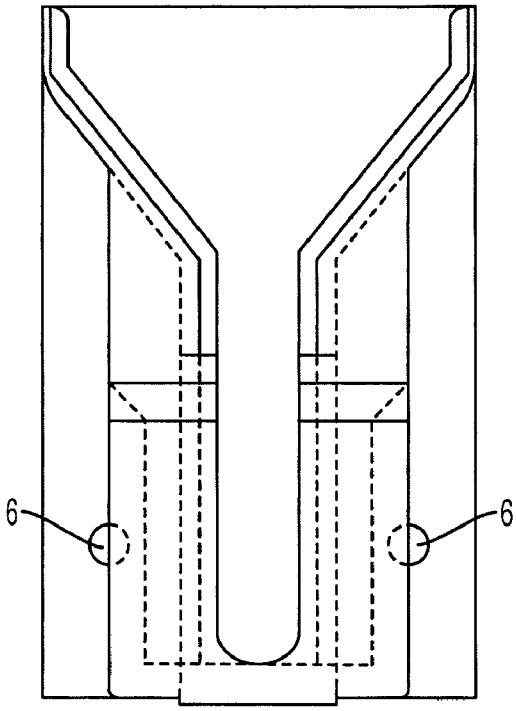
Figures 1, 13:
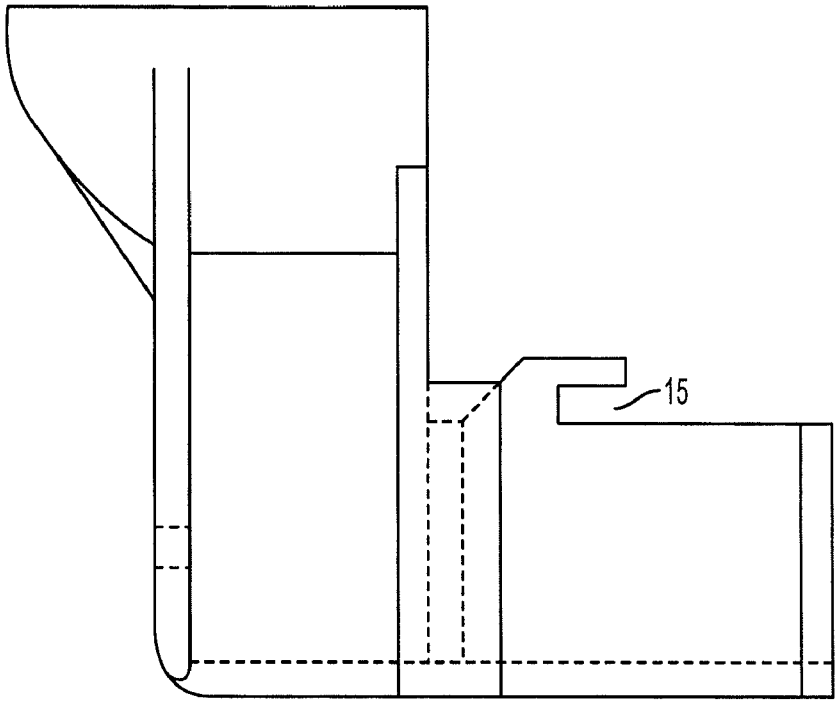
FIG. 13 shows a Profile view of the left half of the Union Elbow of the Vertical Cathode Guide with the Lower Horizontal Guide Profile, when the double omega profile is used as the cathode's bottom horizontal guide.
Figures 2, 12:
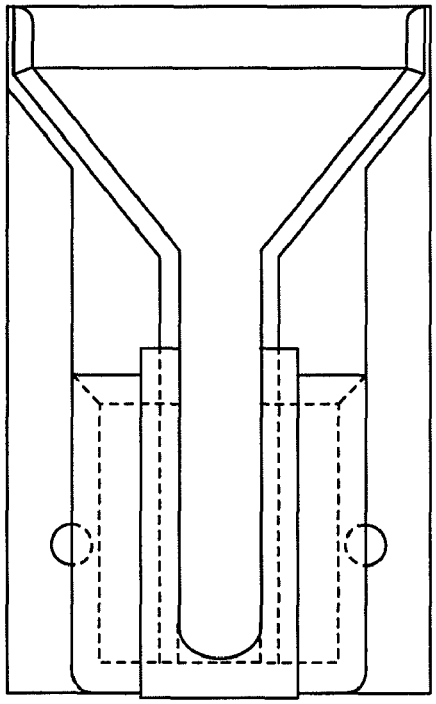
Figures 2, 13:
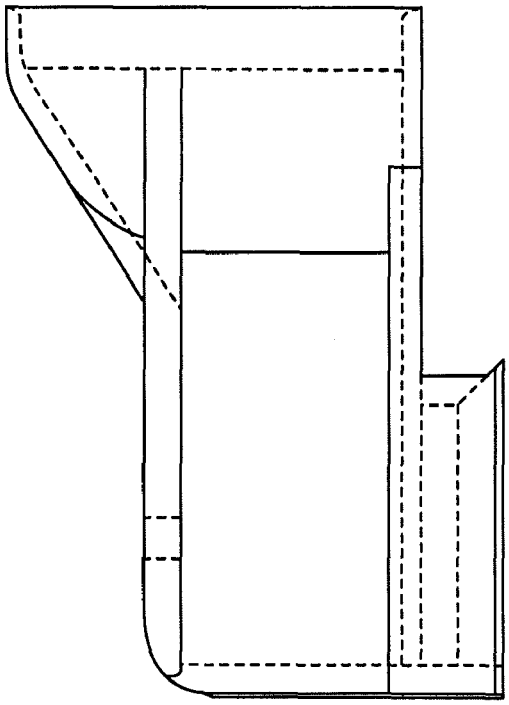
Figure 13:
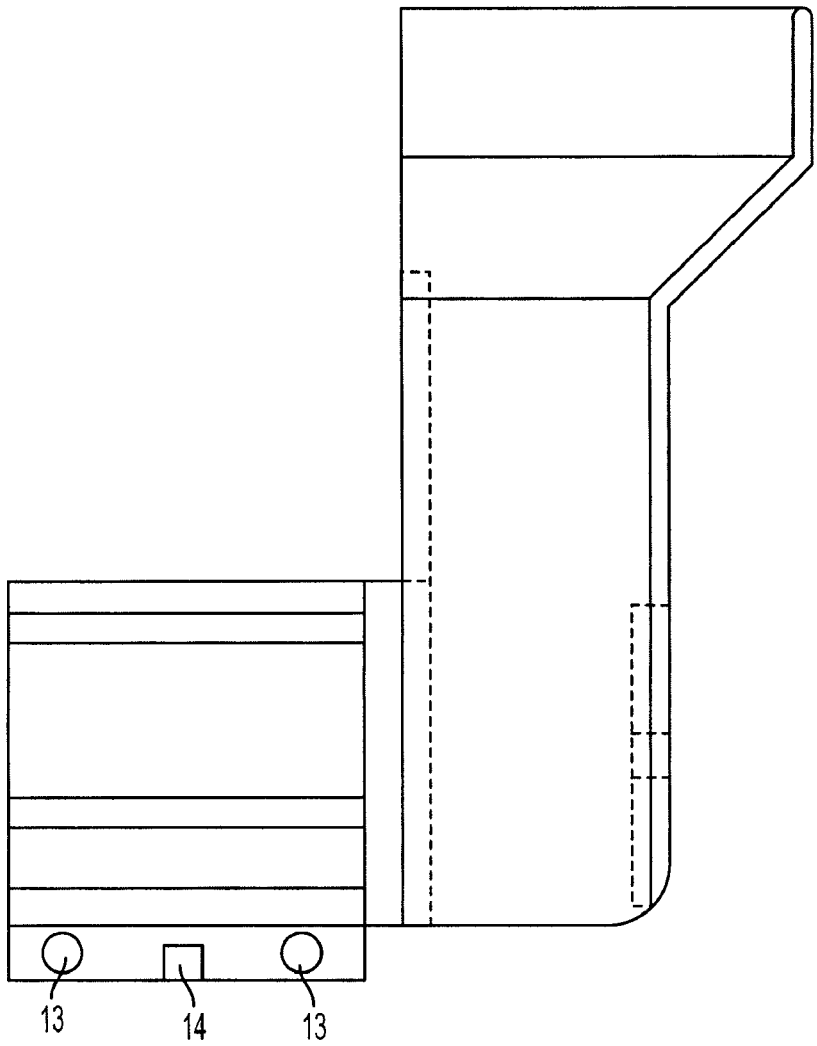
Figure 14:
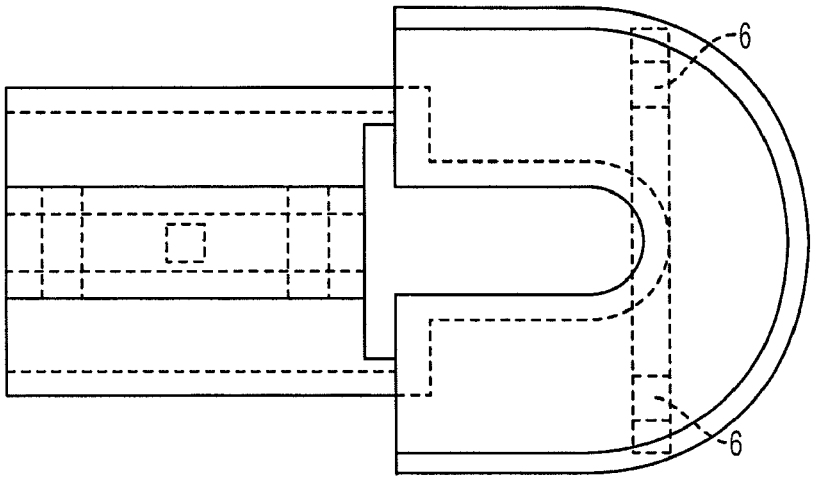
FIG. 14 shows a Plan view of the Elbow Union of the Vertical Cathode Guide with the Lower Horizontal Guide Profile.
Figures 1, 14:
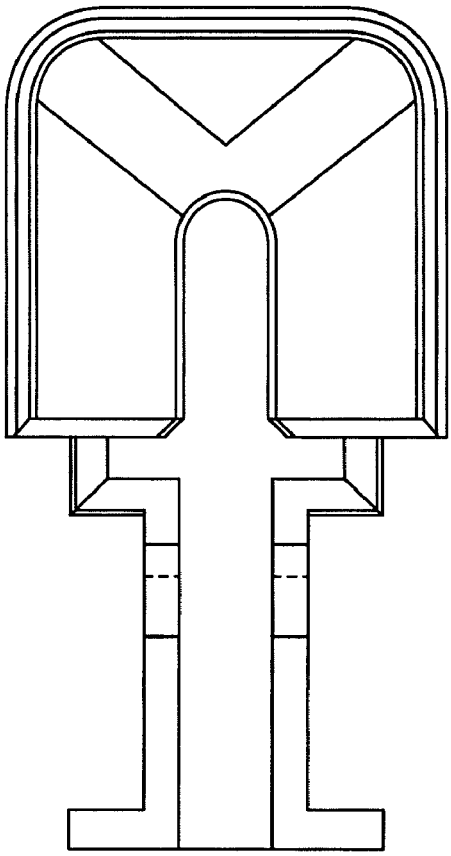
Figures 2, 14:
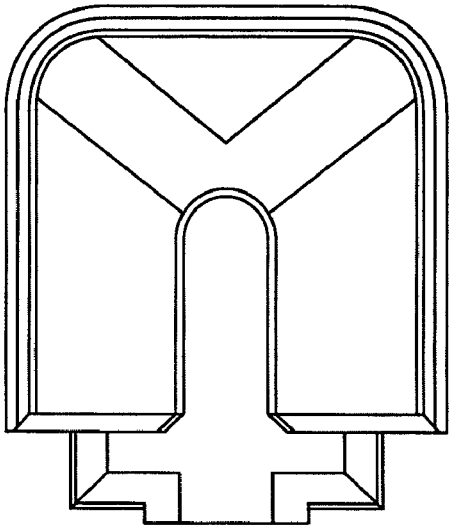

Inferior Horizontal Guide Profiles, like those in FIGS. 10-1 and 11-1.

Figure 15:
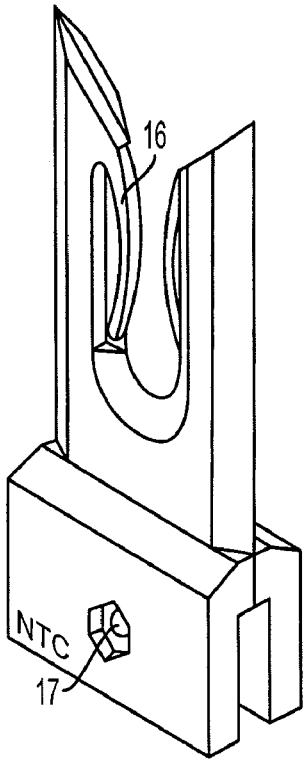
Figures 1, 15:
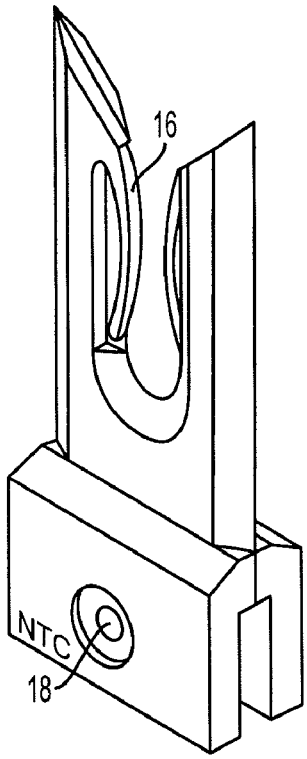
Figures 2, 15:
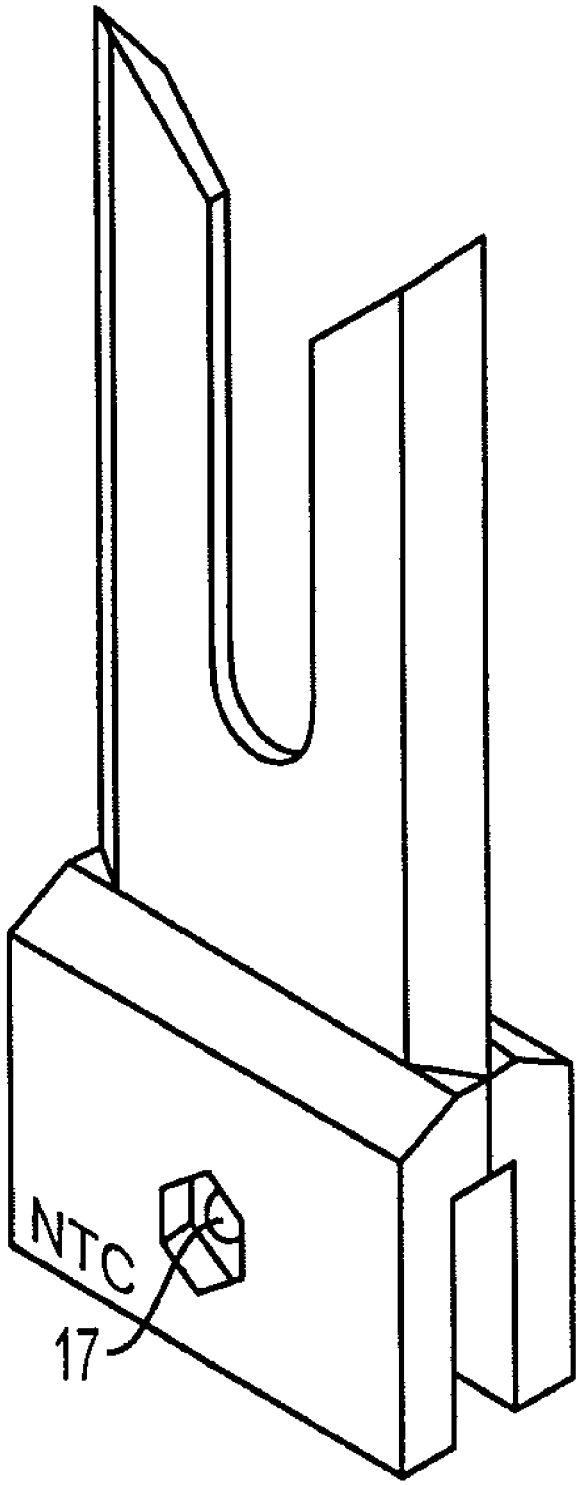
Figure 16:
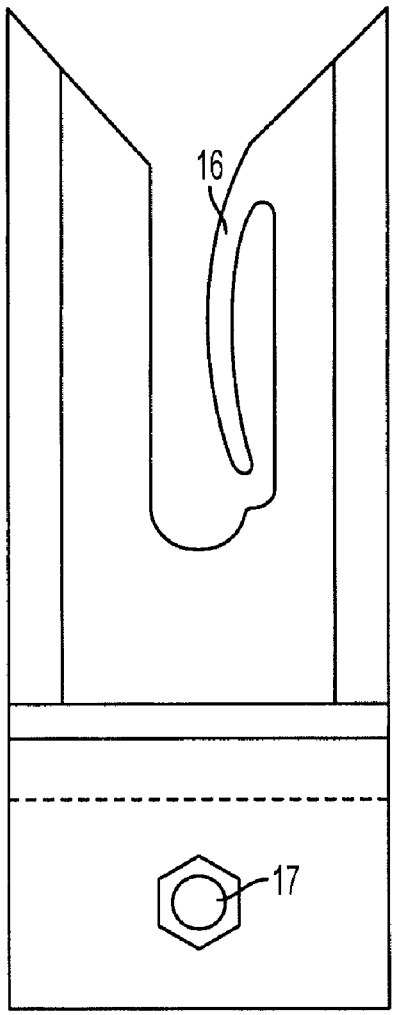
FIG. 16 shows a frontal Elevation view of the part with cylindrical-hexahedral emptying of the Inferior Longitudinal Anode Spacer, in its version with springs.
Figure 17:
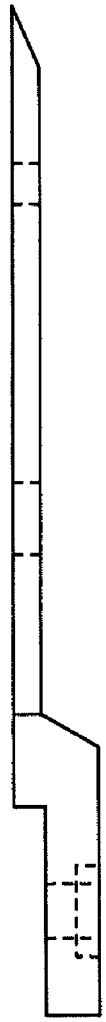
FIG. 17 shows a Profile view of the part with cylindrical-hexahedral emptying of the Inferior Longitudinal Anode Spacer in its version with springs.
Figure 18:
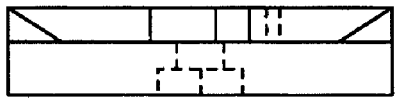
FIG. 18 shows a Plan view of the part with cylindrical-hexahedral emptying of the Inferior Longitudinal Anode Spacer in its version with springs.
Figures 1, 16:
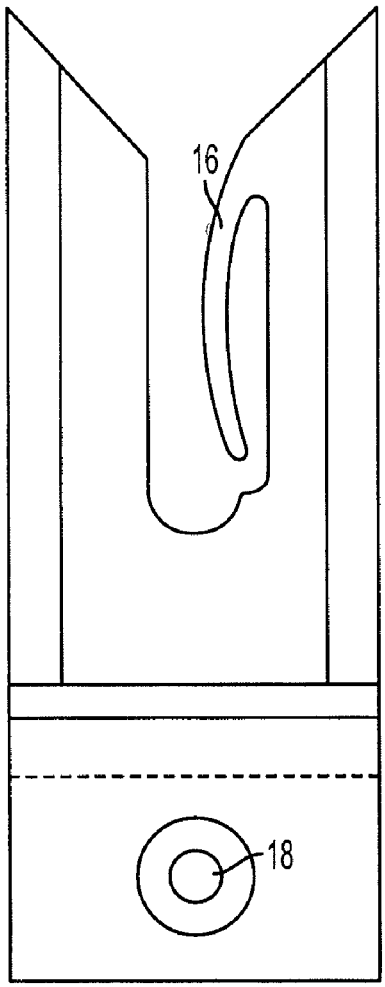
Figures 1, 17:
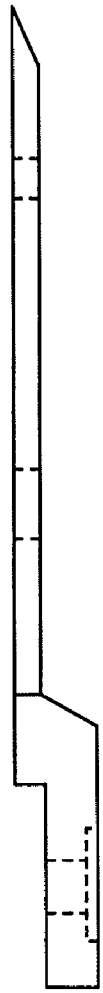
Figures 1, 18:
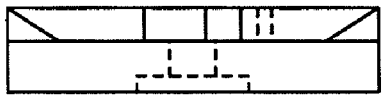
Figures 2, 16:
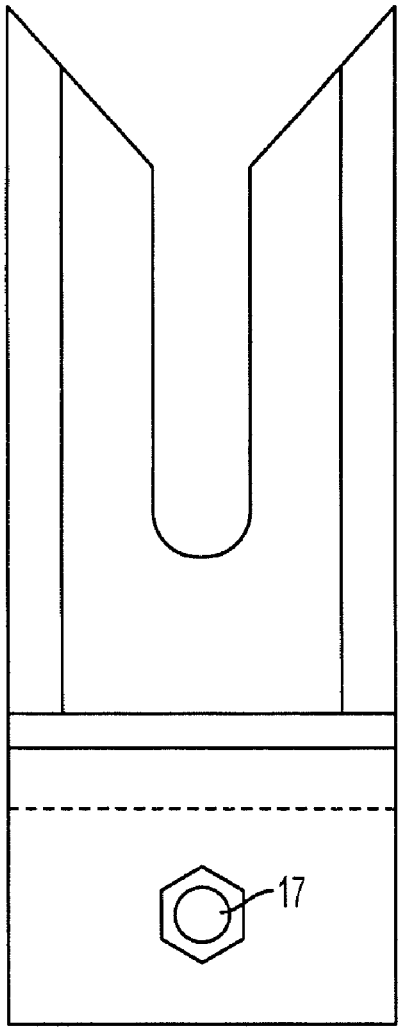
Figures 2, 17:
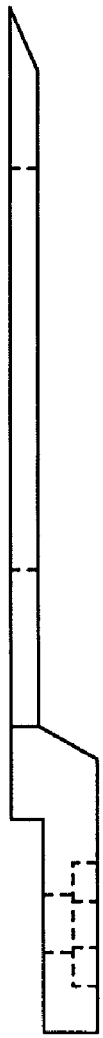
Figures 2, 18:
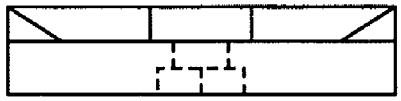
Figures 3, 16:
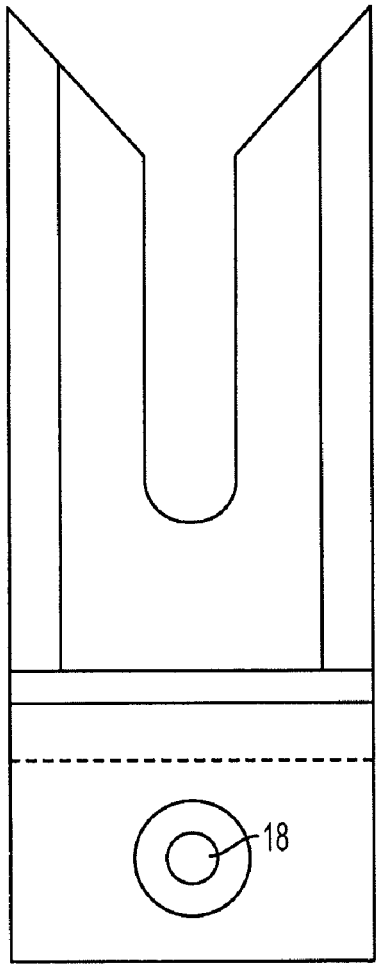
Figures 3, 17:
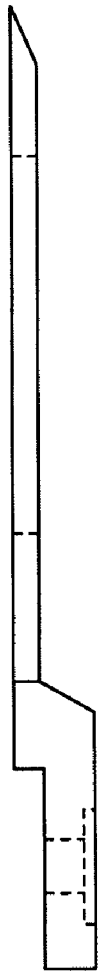
Figures 3, 18:
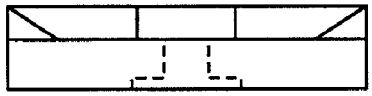
Figure 19:
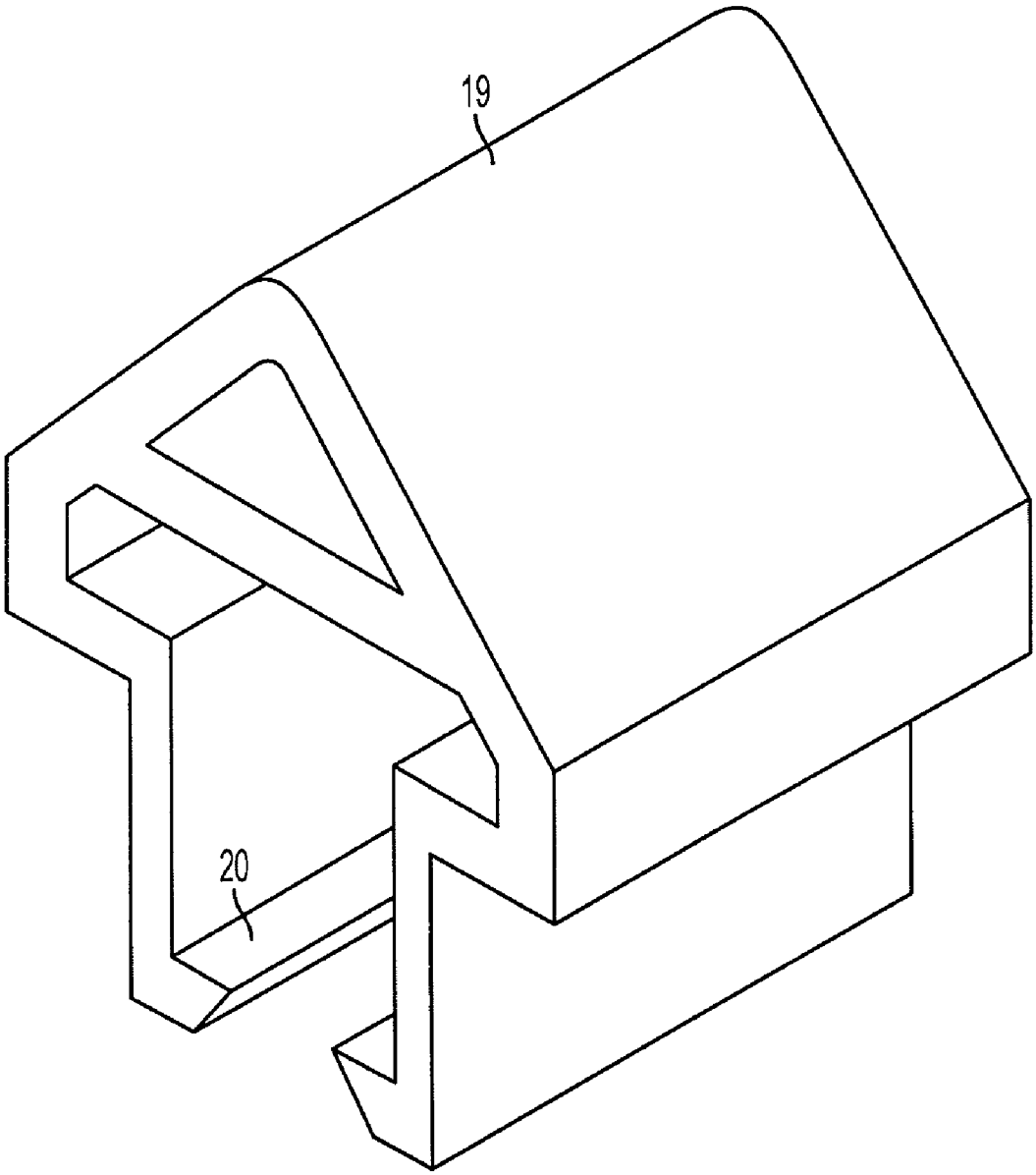
FIG. 19 shows an Isometric view of the external electrode aligner in its simple version.
Figures 1, 19:
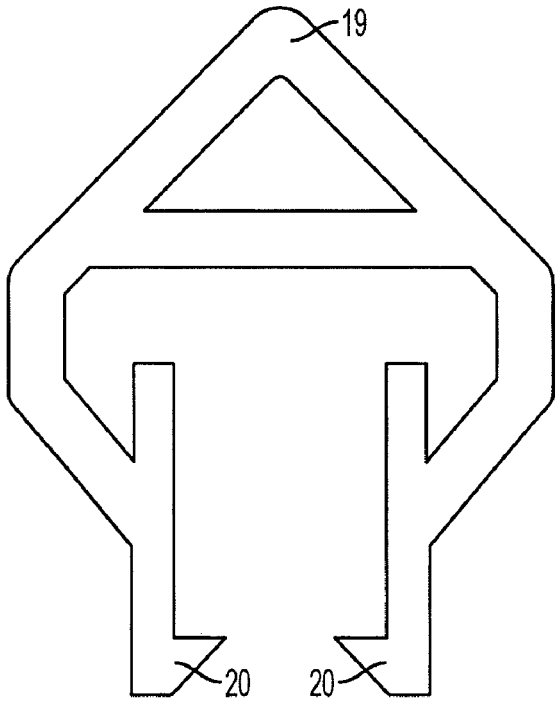
Figures 2, 19:
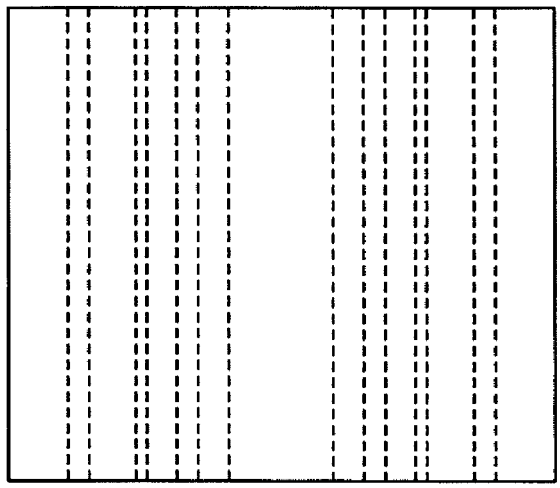
Figures 3, 19:
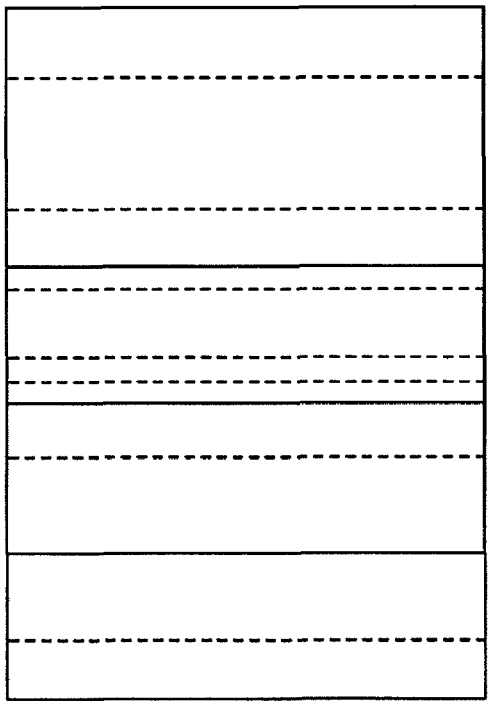
Figures 4, 19:
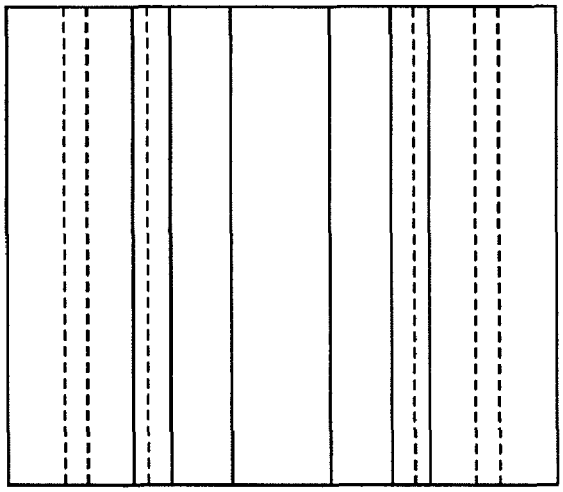
Figure 20:
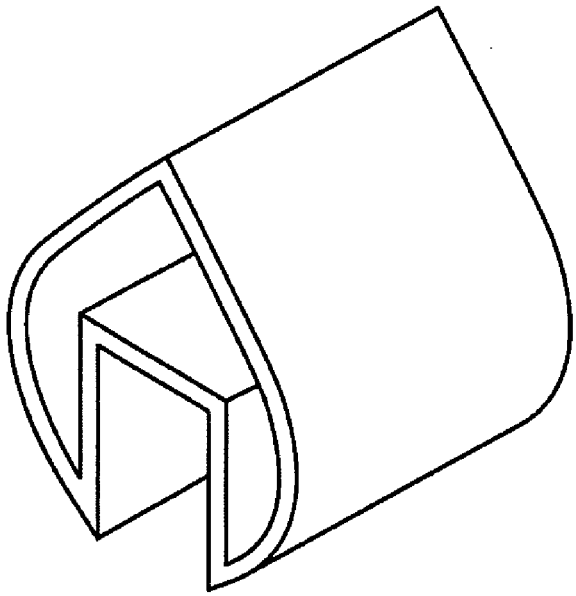
FIG. 20 shows an Isometric view of the external electrode aligner in its ovoid version.
Figure 21:
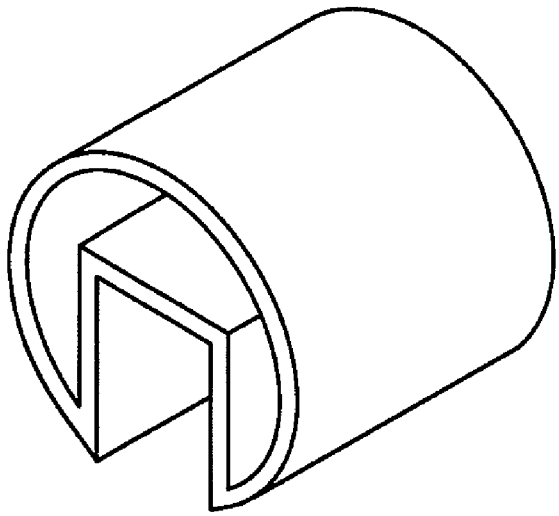
FIG. 21 shows an Isometric view of the external electrode aligner in its cylindrical version.
Figures 1, 20:
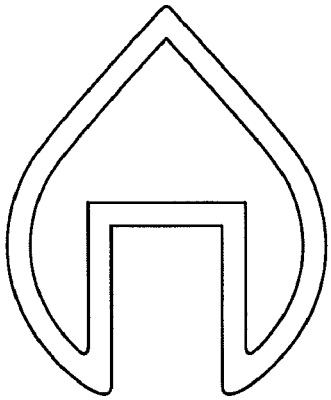
Figures 2, 20:
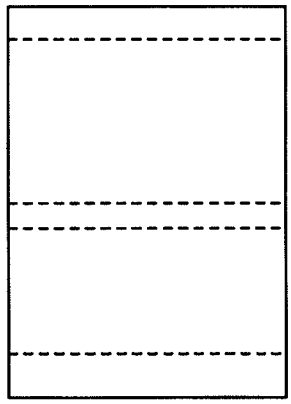
Figures 3, 20:
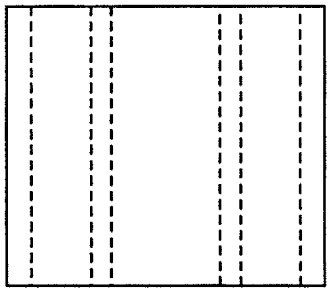
Figures 1, 21:
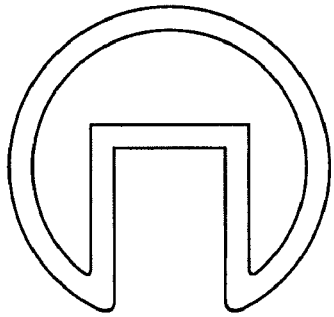
Figures 2, 21:
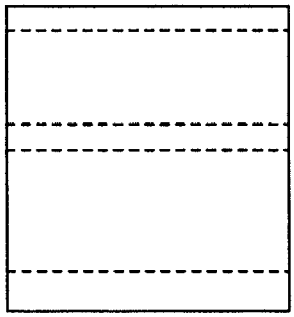
Figures 3, 21:
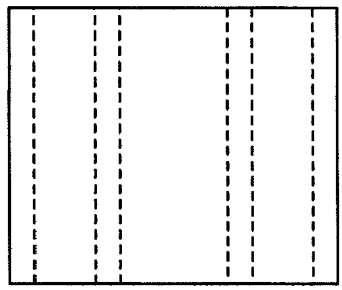

Inferior Longitudinal Spacers of anodes or cathodes, like those in FIGS. 15, 15-1 and 15-2, and External electrode aligner, like those shown in FIGS. 19 and 19-1, used as external guides for the alignment of cathodes during their introduction into the electrolysis Cell or vice versa.

Each one of these elements, on its own, fulfills the function of separators; therefore they can operate jointly or else separately.

The form of the profiles, the elbow and the support for the guides in the structure are determining factors for the objectives that this invention attempts to solve, such as: confer geometric stability to avoid their deformation and make their removal or replacement easier without withdrawing the support structure from the Cell and without the need to empty out the electrolyte. This is achieved simply by removing the bolts from the structure, from the broken or damaged guide and the placing of a new or repaired guide by means of bolts, thereby reducing the loss of production to a minimum.

Description of the Components of the Invention:

Vertical Cathode Guides: These are used to guide the cathodes during their descent into the electrolysis Cell and, at the same time, serve as housing of their vertical borders during the entire time that the deposit of metal in the cathode lasts. The guide is formed by an upper portion 1, which will be named aligning head, and a lower portion 3, that consists of the guide itself In the aligning head, destined to facilitate the introduction of the cathode in the guide, there are hexahedral-cylindrical perforations 2, which make it possible to attach the vertical guide, using bolts or another means, to the electrolytic cell's support structure made of insulating material. The head is formed by a cylindrical housing having a horizontal axis and two inclined symmetrical surfaces that approach each other in a downward line until they become tangential to the interior faces of the "U" profile that continues downward, so that they are similar to a funnel open on one side. The lower portion 3, made up of the actual guide, corresponds to a U-type profile with flanges, which on the outside has triangular 4-1 or rectangular 4-2 stiffening ribs, or both types, preferably separated at regular intervals. The lower end of this guide is introduced into the vertical housing of the union elbow. The interior separation of the opposing faces of the U has a slightly larger dimension than the thickness of the cathode to be employed.

Union Elbows of the Vertical Cathode Guides with Inferior Horizontal Guide Profiles: These are used to house the lower ends of the vertical guides and also the ends of the cathode's inferior horizontal guides, the guides in which the vertical and inferior horizontal borders of the cathodes are housed.

In one version, all the union elbows of the Vertical Cathode Guide with the Inferior Horizontal Guide Profile are made up of two symmetrical halves with regard to their central vertical plane, which are joined by means of two bolts with their respective nuts or another equivalent anchorage system, which are placed in individual cylindrical perforations 13, located in the lower part of the guide. Once its two halves are joined, the Union Elbow can be considered formed by two portions, the upper portion 5 with a shape comparable to half a funnel cut by a vertical centerline plane perpendicular to the symmetry plane, prolonged by rectangular planes 7 in the ridges resulting from the cut through the vertical plane, joined in a right angle to the lower portion shaped like a straight rectangular parallelepiped in a horizontal position, carved interiorly by grooves 9, to house the horizontal guide profile. In the rear lower part a rectangular wall is located vertically in whose projecting ends there are individual perforations 6 used to attach the union elbow of the guides by means of bolts or another system to the support structure of the electrolytic cell.

In another version of the union elbow, designated as the long version of the union elbow, manufactured in a single piece, the upper portion 5 maintains its characteristics, while, in the lower portion, the interior carvings 9 have been suppressed, and in their place the groove 15 has been incorporated to house the flanges of the cathode's inferior horizontal guide, with a "U" profile with flanges and stiffening ribs, like the inferior portion of the vertical cathode guide. In another version of the union elbow, designated as the short version, manufactured in a single piece, the upper portion 5 maintains its characteristics, while the lower portion has been suppressed. In this latter case, a horizontal guide for the cathode is not used and the fixing of the inferior border of the cathode is executed by using an inferior longitudinal spacer.

Inferior Horizontal Guide Profile

The inferior horizontal guide corresponds to a longitudinally straight profile, with a cross-section comparable to an inverted double omega, or a U profile with two flat identical rectangular flanges on each side. The profile is symmetric with regard to the central longitudinal plane. The interior separation of the faces of the "U" that correspond to the zone where the inferior horizontal border of the cathode will be housed, once this horizontal guide profile is installed in the electrolytic cell, is slightly greater than the thickness of the cathode that will be used. The four flanges of the profile are located symmetrically, two on each side, in a straight angle to the lateral walls of the central zone. The two upper flanges located at the open end of the U, point outward. The second pair of flanges, having the same dimensions as the upper ones, is located parallel to and under the upper ones. All the sharp edges and angles formed by the flanges with the center of the profile can be smoothed with chord radii. Depending on the union elbow that is used, the following can be used as an inferior horizontal guide profile: a "U" profile with stiffening ribs such as the one of the lower part of the cathode vertical guides, or also they may not be used and an anode spacer adapted to the cathode's dimensions may be used in their place.

External Electrode Aligner

In all its versions, the external electrode aligner is a longitudinally straight profile, whose cross-section is symmetric with regard to its central vertical plane, broken typically into pieces fifty millimeters long. In the simple version of the external electrode aligner one can distinguish an upper portion 19 that serves as impact attenuator while the cathodes are being introduced into the cell, and an inferior portion 20, destined to be fixed to the upper border of the anode support bar.

The upper portion of the profile can be considered formed by a hollow horizontal prism whose walls have a uniform thickness, with a cross-section comparable to an isosceles right-angled triangle, with a horizontal hypotenuse, whose vertices at the ends of the hypotenuse have been cut back perpendicularly to it, in which the central portion of the hypotenuse has been removed, and a horizontal partition has been added half way up, parallel to the hypotenuse and above it. The inferior portion is formed by two partitions that are joined vertically downward, following the free ends that have remained in the hypotenuse after removing its central portion. Horizontal right-angled trapezoids have been joined to the inferior ends of said vertical partitions, whose oblique sides point in the direction of the central symmetry plane, so that the larger bases remain on top of the smaller bases.

In the reinforced version of the external electrode aligner, the vertical partitions with their clamps 20 are joined to the upper part by means of inclined partitions that connect with each other approximately half way up these. The external electrode aligner, in its ovoid version, is made up by a casing comparable to an ovoid that opens in its lower zone to connect interiorly with a casing of a horizontal straight parallelepiped whose inferior face has been eliminated.

The cylindrical version of the external electrode aligner is made up of a cylindrical casing with horizontal axis that opens in its lower zone to connect interiorly with a casing of a horizontal straight parallelepiped whose inferior face has been eliminated.

In the ovoid and cylindrical versions, the interior separation of the vertical faces of the parallelepiped is slightly inferior to the thickness of the anode or of the support bar of the anode in which they are to be used so that once introduced under pressure they remain in place.

Example of application:

In a support structure made of insulating material, bolts located in the perforations 6 were used to join forty union elbows at the bottom of each side of the cell, in which forty inferior horizontal cathode guides had been inserted previously. Then, the lower ends of forty cathode guides were inserted in the union elbows that were already installed on each side of the Cell, and they were attached to each lateral wall of the structure with bolts passed through the perforations 2 of the vertical cathode guides. Following, forty-one longitudinal inferior anode spacers in their version without springs were put in place, using bolts for this that were located in the type 17 perforations (cylindrical-hexahedral) of the spacers.

Once the union elbows with the horizontal cathode guides, the vertical cathode guides and the forty-one inferior longitudinal anode spacers were installed, the support structure was introduced into the Electrolytic Cell. Then the anodes were installed and on the anode support bar, in the space that is left between the anode itself and the end of the support bar, eighty-two external electrode spacers in their reinforced version were inserted, pressing the caps downward until the clamps were firmly embedded underneath the anode support bars.

Later on the cell was filled with electrolyte, the cathodes were inserted and the electric current was made to circulate. Once the cycle was finished, the cathodes were harvested and the cathode guides were inspected. If any of the cathode guides is damaged, its bolts are loosened, and the damaged guide is raised upward vertically until it is completely removed from the union elbow located at the bottom of the cell. Once the vertical Guide of the damaged cathode is removed, the lower end of the new vertical cathode guide is inserted in the upper portion of the elbow union of the vertical guide with the horizontal cathode guide and the two new bolts are installed through the perforations 2, fixing them by means of their respective nuts to the support structure made of insulating material, without removing it from the Electrolytic Cell and without emptying the electrolyte.

The invention claimed is:

1. A vertical guide for electrodes comprising:

1) an upper portion or aligning head and a lower portion that corresponds to the guide itself, whose aligning head, designed to make it easier to introduce the cathode in the guide, has cylindrical-hexahedral perforations that permit attaching the vertical guide by means of bolts or another means to the electrolytic cell's support structure made of insulating material;

2) the head formed by a cylindrical housing having a horizontal axis and two inclined symmetrical surfaces that approach each other in a downward line until they become tangential to the interior faces of the "U" profile that continues downward, so that they are similar to a funnel open on one side;

3) a lower portion made up of the actual guide, whose space through which the electrode slides must be slightly wider than it, consists of a U-type profile with flanges, and which, on the outside, has triangular, or rectangular stiffening ribs, or both types, preferably separated at regular intervals; and 4) a lower end that is introduced into the vertical housing of the union elbow.

2. A vertical guide for electrodes, according to claim 1, wherein it is a "U" shaped profile with flanges, with its upper end shaped like a funnel.

3. A vertical guide for electrodes, according to claim 1, wherein the interior separation of the opposing faces of the U is of a dimension slightly larger than the thickness of the cathode to be used.

4. A vertical guide for electrodes, according to claim 1, wherein the vertical guide can be bolted to a surface by means of orifices made for this purpose or stud bolts that are inserted in the piece itself.

5. A vertical guide for electrodes, according to claim 1, wherein its profile in the lower portion has triangular and/or rectangular transversal ribs intended to maintain the geometric stability of the guide.

6. A union elbow of vertical or horizontal guides of electrodes, wherein they are used to house the lower ends of the vertical guides and also the ends of the inferior horizontal cathode guides, guides in which the vertical borders and horizontal lower borders of the cathodes are housed and has two portions, the upper portion with a shape comparable to a half funnel cut by a vertical centerline plane perpendicular to the symmetry plane, prolonged by rectangular planes in the edges resulting from the cut through the vertical plane, joined in a right angle to the inferior portion shaped like a straight rectangular parallelepiped in a horizontal position, carved interiorly by grooves, to house the horizontal guide profile; and a lower portion, at the back of which a vertical rectangular wall is located in whose projecting ends there are individual perforations used to attach the union elbow of the guides by means of bolts or another system to the support structure of the electrolytic cell and in the front of which there are two ducts for the introduction of the horizontal guides.

7. A union elbow of vertical or horizontal guides for electrodes, according to claim 6, wherein it is made up of two symmetric halves in relation to its central vertical plane, which are joined by means of two bolts with their respective nuts or with another equivalent anchorage system, which are placed in individual cylindrical perforations located in the lower part of the guide.

8. A union elbow of vertical or horizontal guides for electrodes, according to claim 6, wherein it can be presented as a long version of the union elbow, manufactured in a single piece, the upper portion maintains its characteristics, while, in the lower portion, the interior carvings or ducts have been suppressed, and exchanged for a groove (FIG. 13-1, 15) for the housing or attachment of the flanges of the cathode's inferior horizontal guide, with a "U" profile with flanges and stiffening ribs, like the inferior portion of the vertical cathode guide.

9. A union elbow of vertical or horizontal guides for electrodes, according to claim 6, wherein the union elbows of the vertical guide with horizontal cathode guide, permit the use of horizontal guide profiles of the double omega type.

10. An inferior horizontal guide on which to rest electrodes, comprising:

a longitudinally straight profile, with a cross-section comparable to an inverted double omega or a U profile with flat rectangular flanges, the same on both sides, while the symmetric profile with regard to the central longitudinal plane in which the groove or duct that belongs to the zone in which the cathode's lower horizontal border will be housed is slightly greater than the thickness of the cathode to be used; and four flanges located symmetrically, two on each side, at right angles to the lateral walls of the central zone, where the two upper flanges located in the open end point outwards and the second pair of flanges, of the same dimensions as the upper flanges, are located parallel to and under the upper ones;

said guide containing diagonal or square ribs that maintain the original geometric form; and said inferior horizontal guide allows the cathode or anode to be in a straight position within its lower part.

11. An external electrode aligner, wherein it is a longitudinally straight profile, whose cross-section is symmetric with regard to its central vertical plane in whose upper part there is an attenuator of impacts during the introduction of the cathodes into the cell, and a lower portion destined to be fixed to the upper border of the anode support bar.

12. An external electrode aligner, according to claim 11, wherein the upper portion of the profile has a shape that keeps an electrode from resting on it, inducing it to insert itself in the cathode guide profile.

13. An external electrode aligner, according to claim 11, wherein the lower portion has a shape that permits it to be wedged in the upper part of the anode.

14. A guide system for anodes and/or cathodes in cells for the production of metals via electrolysis, wherein because it includes one or more of the following elements: vertical cathode guides that can be placed on the lateral borders of the cathode; union elbows of vertical guides that can receive the lateral borders of the cathode or the vertical cathode guides; lower horizontal guide profiles of cathodes in which the lower border of a cathode can be inserted; and external aligners for anodes that are fixed on the upper border of the anode support bar.

* * * * *